US010066398B1

(12) United States Patent
Guerrero

(10) Patent No.: US 10,066,398 B1
(45) Date of Patent: Sep. 4, 2018

(54) STAIRWAY SAFETY RAIL SYSTEM

(71) Applicant: Hank Guerrero, Garden City, KS (US)

(72) Inventor: Hank Guerrero, Garden City, KS (US)

( * ) Notice: Subject to any disclaimer, the term of this patent is extended or adjusted under 35 U.S.C. 154(b) by 0 days.

(21) Appl. No.: 15/694,001

(22) Filed: Sep. 1, 2017

(51) Int. Cl.
*E04F 11/18* (2006.01)
*A61H 3/00* (2006.01)

(52) U.S. Cl.
CPC ..... *E04F 11/1863* (2013.01); *A61H 3/00* (2013.01); *E04F 11/1802* (2013.01); *A61H 2003/001* (2013.01)

(58) Field of Classification Search
CPC ..... E04F 11/1863; E04F 11/1802; E04F 11/1808; A61H 2003/001
See application file for complete search history.

(56) References Cited

U.S. PATENT DOCUMENTS

| | | | | |
|---|---|---|---|---|
| 4,253,287 | A | 3/1981 | Overmoe | |
| 4,899,989 | A | 2/1990 | Kitson et al. | |
| 7,395,764 | B2 | 7/2008 | DeBrunner | |
| 7,950,498 | B2 | 5/2011 | Yang et al. | |
| 8,661,740 | B2 * | 3/2014 | Lin | E06B 11/085 248/292.13 |
| 9,133,624 | B2 | 9/2015 | Danziger | |
| 2006/0243112 | A1 * | 11/2006 | Debrunner | B66B 9/0846 83/455 |
| 2007/0017170 | A1 * | 1/2007 | Manson | E04F 11/1863 52/184 |
| 2014/0374681 | A1 * | 12/2014 | Brindamour | E04F 11/1863 256/65.16 |
| 2016/0017611 | A1 * | 1/2016 | Douglas | E04F 11/1863 187/201 |
| 2018/0055714 | A1 * | 3/2018 | Hefron | A61H 3/00 |

FOREIGN PATENT DOCUMENTS

| | | | | |
|---|---|---|---|---|
| CA | 2416225 A1 * | 7/2004 | | A61H 3/00 |
| CN | 107190928 * | 9/2017 | | |
| GB | 2106790 A * | 4/1983 | | E04F 11/1863 |

* cited by examiner

*Primary Examiner* — Robert Canfield
(74) *Attorney, Agent, or Firm* — Global Intellectual Property Agency, LLC; Daniel Boudwin

(57) ABSTRACT

A stairway safety rail system for assisting in ascending and descending a staircase. The stairway safety rail system includes a rail having a channel disposed along a longitudinal axis and a guide block slidably joined to the channel having a plurality of bearings that can move the guide block along the longitudinal axis. A pivot assembly having a rotatable sleeve and a pivot slot secures to the guide block. A handle removably secures to the rotatable sleeve, wherein the rotatable sleeve is pivotally disposed in a working configuration and stored configuration within the pivot slot via a spring loaded release pin. In an alternative embodiment, the plurality of bearings within the guide block each have an adjustable tension, the handle is telescopically adjustable, and a braking strip is applied to a lower end of the channel to restrict movement of the bearings of the guide block.

14 Claims, 5 Drawing Sheets

STAIRWAY SAFETY RAIL SYSTEM

BACKGROUND OF THE INVENTION

The present invention relates to safety support devices. More specifically, the present invention provides a stairway safety rail system for assisting in the ascending and descending of a staircase.

Ascending and descending stairs can be easily accomplished by a healthy individual. For the elderly and physically impaired, this can be one of the most difficult and dangerous tasks performed during their daily routine. Slip and fall occurrences relating to traversing stairwells are significantly higher in the elderly and physically impaired population than compared to the healthy population. Because of the dangers involved, many elderly and physically impaired persons avoid using staircases within their home or in public spaces. This prevents the use of multiple stories within their home and leaves them feeling isolated when unable to enter public spaces only accessible through the use of stairs.

Devices have been disclosed in the known art that relate to safety support devices for ascending and descending stairs. These include devices that have been patented and published in patent application publications. These devices generally relate to safety support devices such as, stair climbing assistance devices and step walkers.

These known art devices have several known drawbacks. Some devices disclose walking bars that can be moved slowly along the stairway one step at a time. These walking bars are then locked into place by using bulky opposing guide rails with guide slots, allowing the user to leave the walking bar locked in a static position at each step thereby providing support. These types of walking bar devices can be cumbersome and difficult to use. Other devices contain braking mechanisms which can lock the walking bar into place when desired. These mechanisms tend to run on a gear and track system which can stick and provide a less smooth transition from descending to ascending movement when in use. Furthermore, these braking mechanisms require the user to manually put them in use, which can be difficult while maintaining a grip on the walking bar for support in addition to descending or ascending a staircase. Finally, some devices disclose bars or handles that are not adjustable to the height of the user. These devices limit the ease of use for taller or shorter individuals.

In light of the devices disclosed in the known art, it is submitted that the present invention substantially diverges in design elements from the known art and consequently it is clear that there is a need in the art for an improvement to existing safety support devices. In this regard, the instant invention substantially fulfills these needs.

SUMMARY OF THE INVENTION

In view of the foregoing disadvantages inherent in the known types of safety support devices now present in the known art, the present invention provides a new stairway safety rail system wherein the same can be utilized for providing convenience for a user when ascending or descending a staircase.

It is therefore an object of the present invention to provide a new and improved stairway safety rail system device that has all of the advantages of the known art and none of the disadvantages. The stairway safety rail system comprises a rail having a channel disposed along a longitudinal axis thereof and a guide block slidably joined to the channel, wherein the guide block includes a plurality of bearings configured to move along the longitudinal axis. The rail is configured to secure to a wall, such as a stairway wall. The device further includes a pivot assembly having a rotatable sleeve, a spring loaded release pin, and a pivot slot, wherein the pivot assembly attaches securely to the guide block. A handle removably secures to the rotatable sleeve of the pivot assembly, wherein the rotatable sleeve positions the handle in a working configuration and a stored configuration within the pivot slot by utilizing a spring loaded quick release pin.

It is another object of the present invention to provide a stairway safety rail system wherein the working configuration is configured to extend the handle outwardly perpendicular from the rail in a horizontal position relative to a floor and the stored configuration places the handle in a vertical position above the rail perpendicular to the floor.

Another object of the present invention is to provide a stairway safety rail system, wherein the handle has a first grab bar and a second grab bar, wherein the first grab bar and second grab bar are disposed on opposing sides of a plurality of cross sectional members. In an alternative embodiment, the cross sectional members are telescopically adjustable in length by utilizing a plurality of pin and hole adjustment slots.

Yet another object of the present invention is to provide a stairway safety rail system, wherein a braking strip is disposed within a lower end of the channel. The braking strip is configured to restrict the movement of the plurality of bearings within the guide block. In an alternate embodiment, the plurality of bearings each have an adjustable tension, configured to limit movement along the longitudinal axis of the channel.

Yet another object of the present invention is to provide a stairway safety rail system, wherein the rail has a pair of opposing distal ends such that a first distal end contains a first stopper and a second distal end contains a second stopper, wherein both stoppers are configured to confine the guide block thereon the channel of the rail.

Another object of the present invention is to provide a stairway safety rail system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
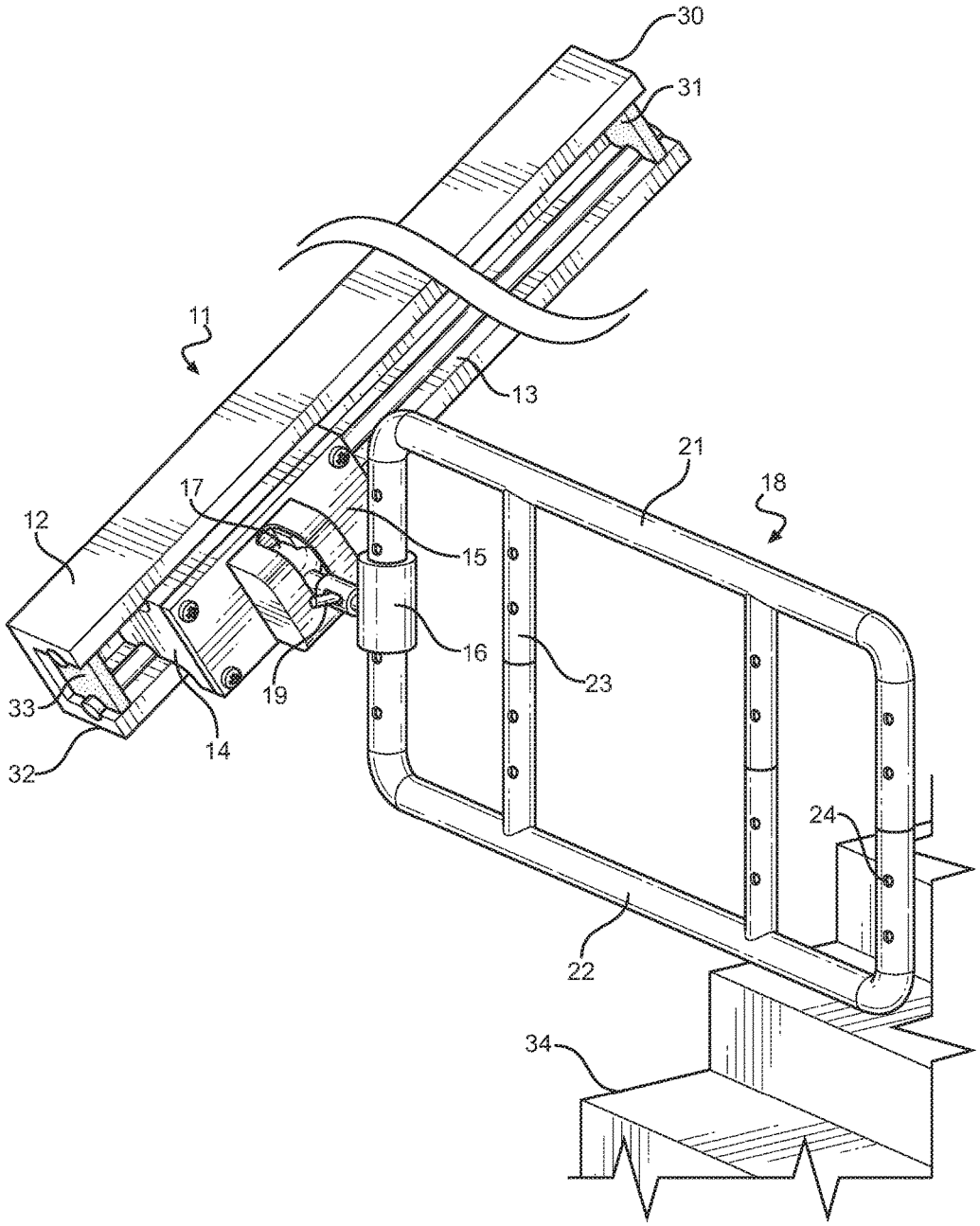
FIG. 1 shows a perspective view of the stairway safety rail system, wherein the handle is in a working configuration.

Reference is made herein to the attached drawings. Like reference numerals are used throughout the drawings to depict like or similar elements of the stairway safety rail system. For the purposes of presenting a brief and clear description of the present invention, the preferred embodiment will be discussed as used for ascending and descending a staircase. The figures are intended for representative purposes only and should not be considered to be limiting in any respect.

Referring now to FIG. 1, there is shown a perspective view of the stairway safety rail system, wherein the handle is in a working configuration. The stairway safety rail system 11 comprises a rail 12 having a channel 13 disposed along a longitudinal axis thereof, and a guide block 14 slidably joined to the channel 13, wherein the guide block 14 is configured to move along the longitudinal axis. In the illustrated embodiment, the rail 12 is configured to secure to a wall, such as a stairway wall, via a fastener. The rail 12 has a pair of opposing distal ends such that a first distal end 30 contains a first stopper 31 and a second distal end 32 contains a second stopper 33, wherein both stoppers are configured to confine the guide block 14 thereon the channel 13 of the rail 12.

The device 11 further comprises a pivot assembly 15 secured to the guide block 14. The pivot assembly 15 includes a rotatable sleeve 16, a spring loaded release pin 19, and a pivot slot 17. A handle 18 removably attaches to the rotatable sleeve 16. The spring loaded release pin 19 is configured to engage and disengage within the pivot slot 17. When the spring loaded release pin 19 is disengaged, the rotatable sleeve 16 can be positioned between a working configuration and a stored configuration along the pivot slot 17. The working configuration is configured to extend the handle 18 perpendicularly from the rail in a vertical position relative to a floor 34.

In the illustrated embodiment, the handle 18 comprises a first grab bar 21 and a second grab bar 22. The first grab bar 21 and second bar 22 are disposed on opposing sides of a plurality of cross sectional members 23. When in the working position, the first grab bar 21 and second grab bar 22 are parallel in relation to the floor 34. In the illustrated embodiment, the plurality of cross sectional members 23 are telescopically adjustable in length, such that the distance between the first grab bar 21 and second grab bar 22 can be varied in length. The lengths of the plurality of cross sectional members 23 are locked into place by utilizing fasteners, such as a pin and hole adjustment slot 24. In the illustrated embodiment, the grab bars 21, 22 are configured to be adjustable based on the height and preference of a user, whereby the first grab bar 21 extends upwardly in height relative to the floor and the second grab bar 22 extends downwardly in height relative to the floor 34.

In the illustrated embodiment, the handle 18 is a substantially rectangular shape, but in alternative embodiments, the handle 18 may be any shape, such as circular, oval, or square. When in the working configuration the first grab bar 21 is positioned near a sternum of a user while the second grab bar 22 is positioned near a navel area. This positioning allows the user to easily grasp the grab bars while ascending or descending a stairwell. In alternative embodiments, the user can adjust the position of the grab bars to their preference by utilizing the pin and hole adjustment slots 24.

Figure 2A:
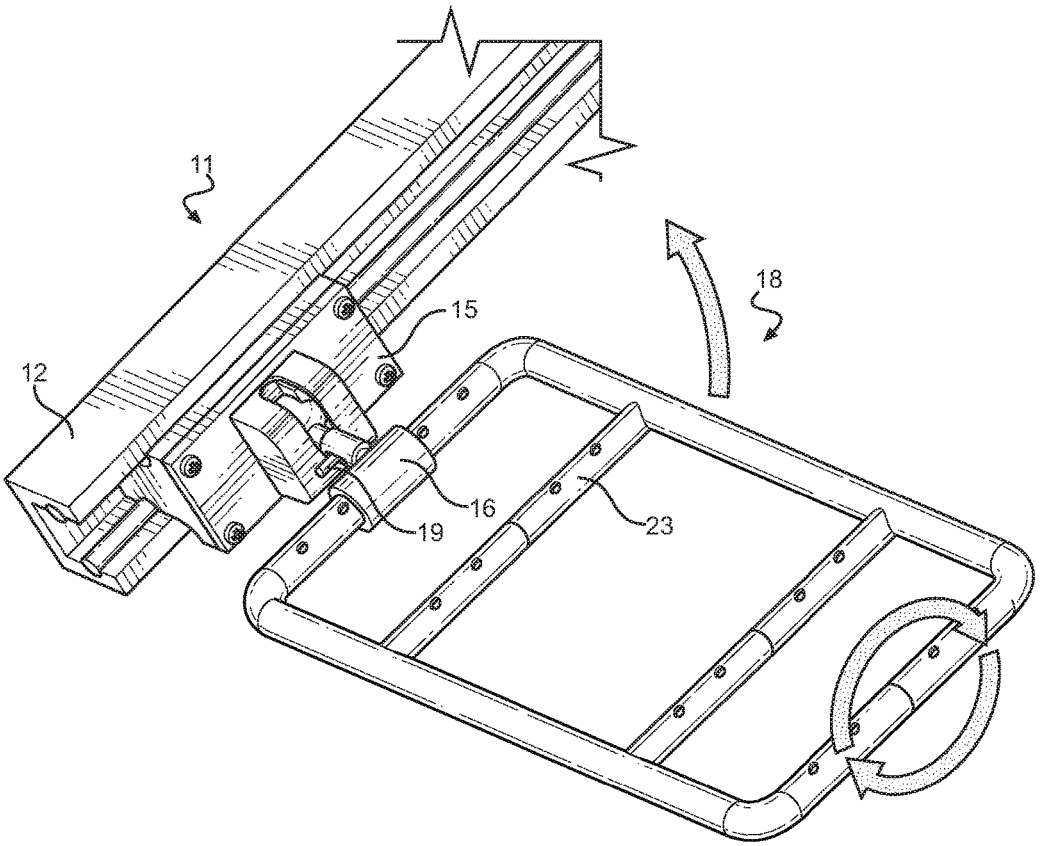
FIG. 2A shows a perspective view of the stairway safety rail system, wherein the handle is positioned parallel to the longitudinal axis of the rail.
Figure 2B:
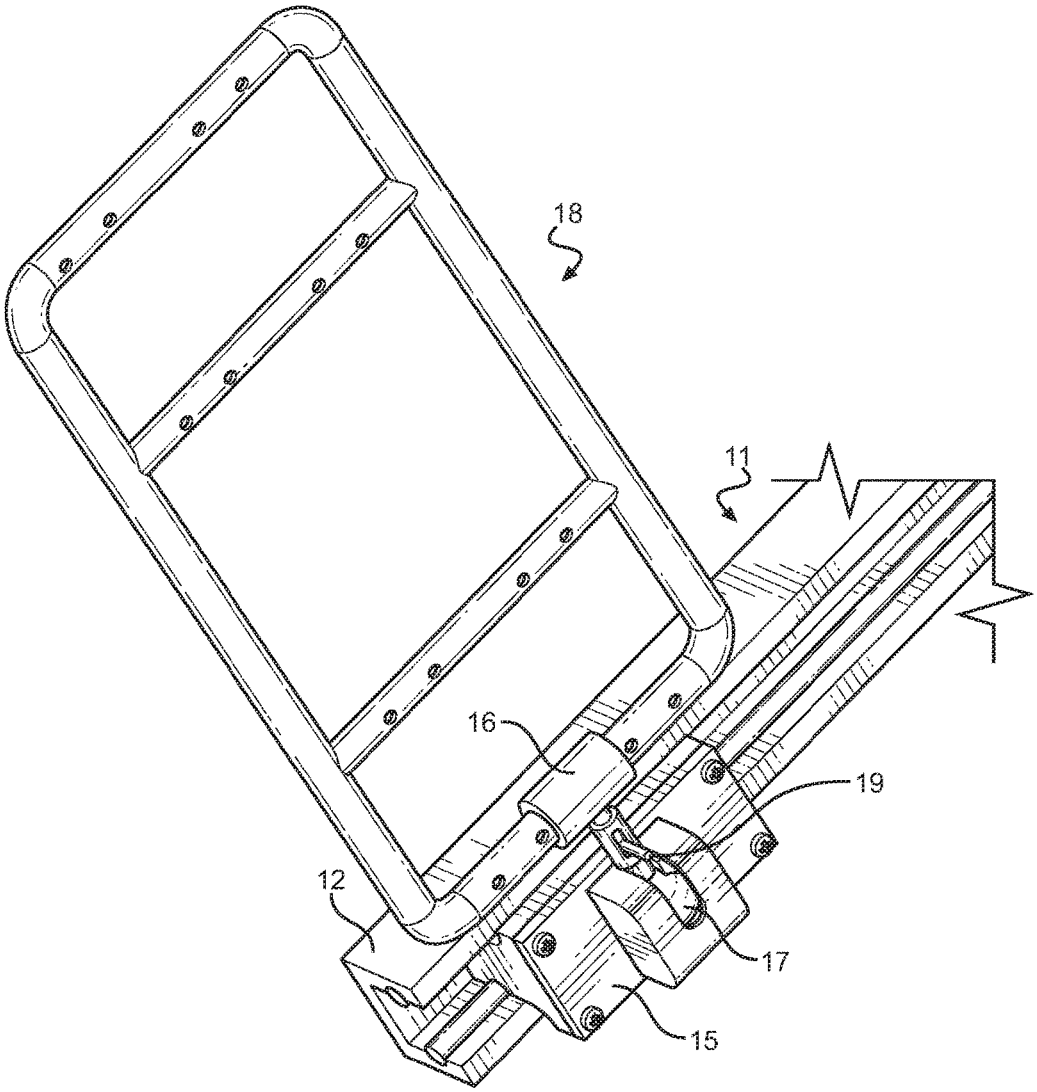
FIG. 2B shows a perspective view of the stairway safety rail system, wherein the handle is in a stored configuration.

Referring now to FIG. 2A and FIG. 2B, there is shown a perspective view of the stairway safety rail system, wherein the handle is positioned parallel to the longitudinal axis of the rail and a perspective view of the stairway safety rail system, wherein the handle is in a stored configuration, respectively. In the illustrated embodiment, the spring loaded release pin 19 of the pivot assembly 15 is disengaged, thereby allowing the rotatable sleeve 16 to rotate around its axis, disposing the cross sectional members 23 of the handle 18 in parallel with the rail 12. Once disposed in this position, the rotatable sleeve 16 can pivot within the pivot slot 17, thereby allowing the handle 18 to be placed in the stored configuration. When in the stored configuration, the handle 18 is elevated above the rail 12 perpendicular in relation to the floor.

The handle 18 is held in place by engaging the spring loaded release pin 19 within the pivot slot 17. The stored configuration allows the user to store the handle 18 in a position that will not interfere with ascending and descending the stairs. When needed, the release pin 19 can be disengaged and the handle 18 can be placed back in the working configuration.

Figure 3:
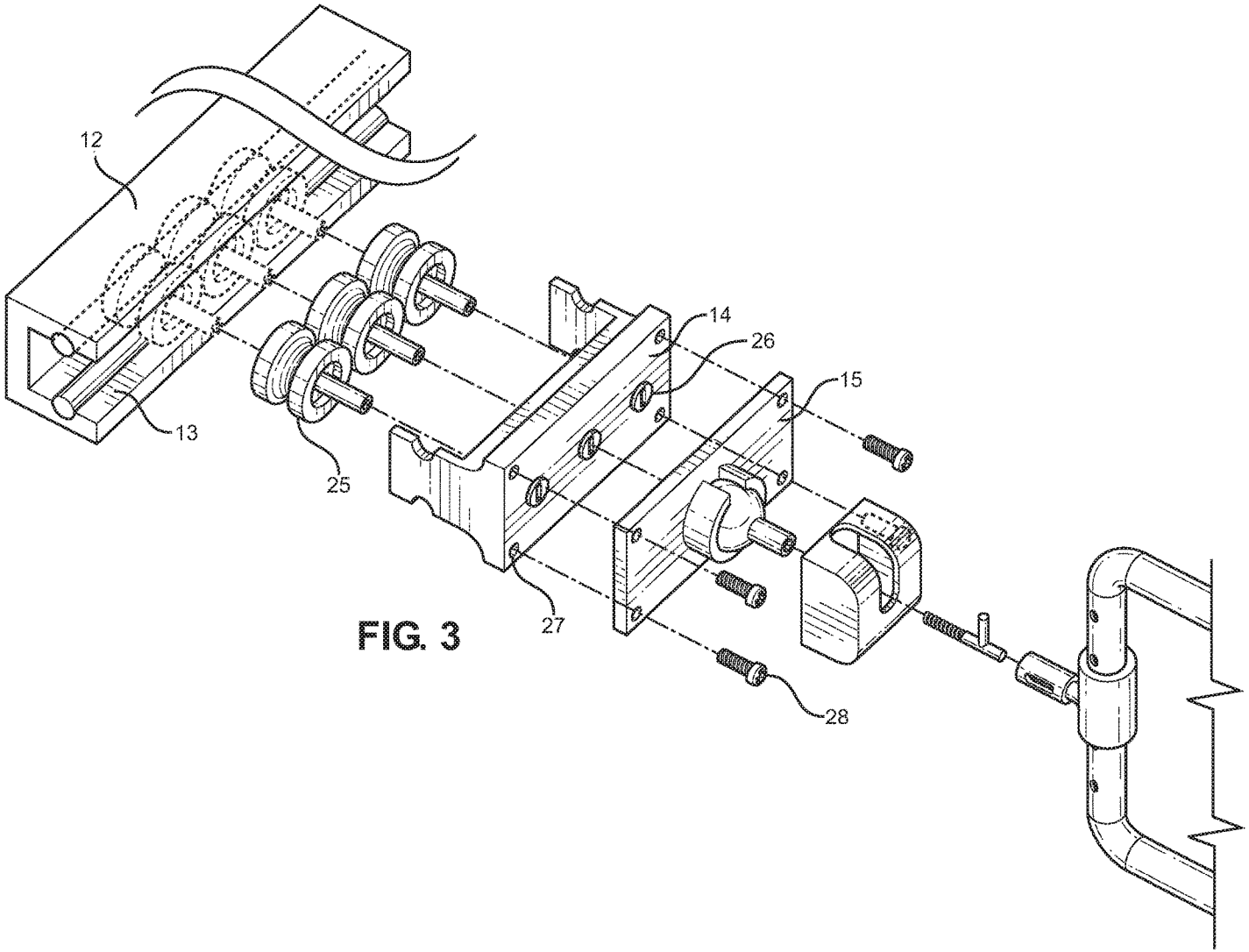
FIG. 3 shows an exploded view of the guide block and pivot assembly of the stairway safety rail system.

Referring now to FIG. 3, there is shown an exploded view of the guide block and pivot assembly of the stairway safety rail system. In the illustrated embodiment, the guide block 14 is configured with a plurality of bearings 25, wherein the bearings 25 are configured to have an adjustable tension. The plurality of bearings 25 can be any type of bearing, such as a sleeve bearing or groove bearing. The tension of the bearings can be adjusted by utilizing a plurality of bolt heads 26 secured thereon the guide block 14. The tension of the bearings 25 can be increased or decreased by turning the bolt heads 26 in a clockwise or counterclockwise direction, respectively. The increased or decreased tension of the bearings restricts or allows movement of the guide block 14 within the channel 13 along the axis of the rail 12, respectively. The adjustable tension allows the user to determine how fast the guide block 14 of the device 11 travels while in use during descent or ascent of a stairway. Users with more physical impairment can adjust the tension so that the device moves at a slower pace, thereby provide more support during stair climbing or descending. Once the tension is set to a desired preference, the pivot assembly 15 can be removable secured to the guide block 14 via fasteners, such as screws 28 and threaded holes 27. In the illustrated embodiment, the individual components of the device 11 are constructed of a rigid material, such as steel. In alternative embodiments, the components of the device 11 can be constructed of any rigid material, such as aluminum or a metal alloy.

Figure 4:
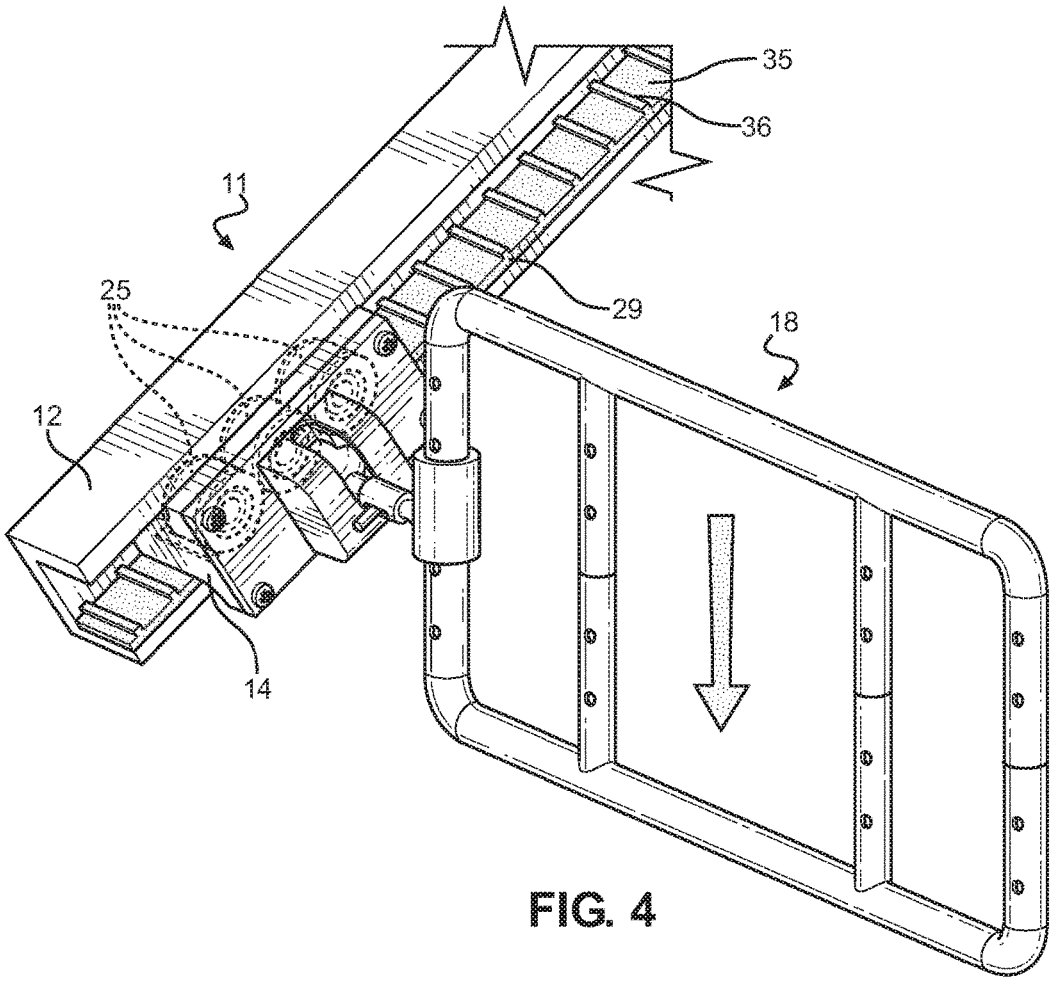
FIG. 4 shows a perspective view of the stairway safety rail system, wherein the channel contains a braking strip.

Referring now to FIG. 4, there is shown a perspective view of the stairway safety rail system, wherein the channel contains a braking strip. In the illustrated embodiment, the guide block 14 is equipped with a plurality of bearings 25 and the rail 12 contains a braking strip 29 applied to a lower surface within the channel of the rail 12. The braking strip 29 is constructed of a resilient material, such as rubber, in order to withstand repeated frictional engagement with the bearings and the applied force of a user thereagainst. The braking strip 29 extends the length of the channel and comprises raised protrusions 36 disposed at fixed intervals along the length thereof. A recess 35 is disposed between each raised protrusion 36, wherein each recess 35 is configured to receive a bearing 25 therein.

The braking strip 29 is configured to allow movement of the bearings 25 along the channel when a force parallel to the longitudinal axis is applied to the handle 18. The parallel force is created by the user when pushing on the handle 18 when ascending or descending stairs. As a recess 35 receives a bearing 25, the parallel force is required to surmount the raised protrusion 36 thereon the braking strip 29. The braking strip 29 is further configured to stop the guide block 14 when a downward force, perpendicular to the floor, is applied to the handle 18. When the downward force is applied to the handle 18, the bearings 25 are pushed downward perpendicular to the floor, into the braking strip 29. The downward force stops the movement of the plurality bearings 25 by lodging the bearings 25 within the resilient material of the recess 35, thereby stopping movement of the guide block 14 and handle 18. The downward force is generated by the user during an action, such as falling or slipping, thereby allowing the user to grab the handle 18 of the stopped device 11 for support.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stairway safety rail system comprising:

a rail having a channel disposed along a longitudinal axis thereof;

a guide block slidably joined to the channel, wherein the guide block has a plurality of bearings configured to move along the longitudinal axis;

a pivot assembly having a rotatable sleeve and a pivot slot, wherein the pivot assembly is secured to the guide block;

a handle removably secured to the rotatable sleeve, wherein the rotatable sleeve is disposed within the pivot slot;

a spring loaded release pin contained within the rotatable sleeve.

2. The stairway safety rail system of claim 1, wherein a braking strip is disposed within a lower surface of the channel, configured to restrict the movement of the plurality of bearings.

3. The stairway safety rail system of claim 2, wherein the braking strip extends a length of the channel and comprises a plurality of raised protrusions disposed at fixed intervals along the length thereof and a plurality of recesses, wherein each recess is disposed between two raised protrusions, and configured to receive a bearing therein.

4. The stairway safety rail system of claim 1, wherein the plurality of bearings each have an adjustable tension, configured to limit movement along the longitudinal axis.

5. The stairway safety rail system of claim 4, wherein a plurality of bolt heads are disposed thereon the guide block, whereby each bolt head is connected to a bearing of the plurality of bearings such that turning the bolt head adjusts the tension of the bearing.

6. The stairway safety rail system of claim 1, wherein the pivot assembly is operable to allow the handle to be locked within the pivot slot in a working configuration and a stored configuration by using the spring loaded release pin.

7. The stairway safety rail system of claim 6, wherein the working configuration is configured to extend the handle outwardly perpendicular from the rail in a horizontal position relative to a floor.

8. The stairway safety rail system of claim 6, wherein the stored configuration places the handle in a vertical position above the rail perpendicular to a floor.

9. The stairway safety rail system of claim 1, wherein the handle has a first grab bar and a second grab bar whereby the first grab bar and second grab bar are disposed on opposing sides of a plurality of cross sectional members.

10. The stairway safety rail system of claim 9, wherein the plurality of cross sectional members are telescopically adjustable in length, configured to vary the distance between the first grab and the second grab bar.

11. The stairway safety rail system of claim 1, wherein the handle is substantially rectangular.

12. The stairway safety rail system of claim 1, wherein the rail is configured to secure to a wall.

13. The stairway safety rail system of claim 1, wherein the rail has a pair of opposing distal ends such that a first distal end contains a first stopper and a second distal end contains a second stopper wherein both stoppers are configured to confine the guide block thereon the channel of the rail.

14. The stairway safety rail system of claim 1, wherein the plurality of bearings are sleeve bearings.

* * * * *